US009570850B2

(12) United States Patent
Blakborn

(10) Patent No.: US 9,570,850 B2
(45) Date of Patent: Feb. 14, 2017

(54) SYSTEM FOR THE TRANSMISSION OF ELECTRICAL CURRENT

(71) Applicant: ROSENBERGER HOCHFREQUENZTECHNIK GMBH & CO. KG., Fridolfing (DE)

(72) Inventor: Willem Blakborn, Inzell (DE)

(73) Assignee: Rosenberger Hochfrequenztechnik GmbH & Co., KG, Fridolfing (DE)

( * ) Notice: Subject to any disclaimer, the term of this patent is extended or adjusted under 35 U.S.C. 154(b) by 0 days.

(21) Appl. No.: 14/386,506

(22) PCT Filed: Mar. 18, 2013

(86) PCT No.: PCT/EP2013/000816
§ 371 (c)(1),
(2) Date: Sep. 19, 2014

(87) PCT Pub. No.: WO2013/139461
PCT Pub. Date: Sep. 26, 2013

(65) Prior Publication Data

US 2015/0050824 A1 Feb. 19, 2015

(30) Foreign Application Priority Data

Mar. 20, 2012 (DE) ..... 20 2012 002 933

(51) Int. Cl.

| | |
|---|---|
| ***H01R 4/66*** | (2006.01) |
| ***H01R 13/631*** | (2006.01) |
| ***H01R 4/48*** | (2006.01) |
| ***H01R 13/17*** | (2006.01) |
| ***H01R 13/187*** | (2006.01) |
| ***H01R 13/33*** | (2006.01) |

(52) U.S. Cl.
CPC ..... *H01R 13/6315* (2013.01); *H01R 4/4863* (2013.01); *H01R 4/66* (2013.01); *H01R 13/17* (2013.01); *H01R 13/187* (2013.01); *H01R 13/33* (2013.01)

(58) Field of Classification Search
CPC ..... H01R 13/17; H01R 13/33; H01R 13/187; H01R 13/6315; H01R 4/4863; H01R 13/10; Y10S 439/927
USPC ..... 439/252, 100, 805, 840, 841, 927
See application file for complete search history.

(56) References Cited

U.S. PATENT DOCUMENTS

| | | | | |
|---|---|---|---|---|
| 4,083,622 A * | 4/1978 | Neidecker | ..... | H01R 13/187 439/843 |
| 5,727,821 A * | 3/1998 | Miller | ..... | F16L 37/088 285/308 |
| 6,749,358 B2 * | 6/2004 | Balsells | ..... | H01R 13/187 403/315 |

(Continued)

FOREIGN PATENT DOCUMENTS

| | | | | |
|---|---|---|---|---|
| DE | 20 2011 003 555 U1 | 5/2011 | | |
| WO | WO 2010118344 A1 * | 10/2010 | ..... | H01R 13/187 |

*Primary Examiner* — Tulsidas C Patel
*Assistant Examiner* — Travis Chambers
(74) *Attorney, Agent, or Firm* — DeLio, Peterson & Curcio, LLC; Robert Curcio

(57) ABSTRACT

A system for the transmission of electrical current that has at least two rigid conductors, wherein the two conductors are connected via at least one electrically conducting, deformable connecting element, which can comprise a helical spring that is shaped like a ring in the direction of the longitudinal axis thereof and grips a section of a first conductor under pre-tension.

18 Claims, 2 Drawing Sheets

(56) References Cited

U.S. PATENT DOCUMENTS

| | | | | |
|---|---|---|---|---|
| 6,966,802 | B2 * | 11/2005 | Hielscher | H01R 13/187 439/840 |
| 8,375,543 | B1 * | 2/2013 | Balsells | B23P 17/00 267/167 |
| 8,888,537 | B2 * | 11/2014 | Do | H01R 13/187 439/668 |
| 2006/0270286 | A1 * | 11/2006 | Zhao | H01M 2/206 439/840 |
| 2010/0261361 | A1 * | 10/2010 | Kasparian | H01R 13/187 439/259 |
| 2011/0281476 | A1 | 11/2011 | Sjostedt | |
| 2013/0330981 | A1 * | 12/2013 | Blakborn | H01R 13/113 439/788 |

* cited by examiner

SYSTEM FOR THE TRANSMISSION OF ELECTRICAL CURRENT

BACKGROUND OF THE INVENTION

1. Field of the Invention

The invention relates to a system for the transmission of electrical current comprising at least two electrically conducting rigid conductors which are connected with one another.

2. Description of Related Art

It is known for electrical current and in particular high current to be transmitted via conductors which are designed as large-volume, solid metal components, i.e., which are substantially rigid. The use of rigid conductors leads to the problem that electrical functional elements which are to be connected via these conductors need to be positioned relatively exactly in relation to one another, since a compensation of positioning tolerances is not readily possible due to the rigidity of the conductors. This problem could be solved in that the at least two conductors of the system are connected together with a defined play. However, in that case the contact surface area between the two conductors varies depending on their relative location, which could be associated with unsatisfactory transmission behavior for the current. For example it is known, in the drive train of an electric motor vehicle, for a power distributor to be connected with the power electronics via a system of rigid conductors.

SUMMARY OF THE INVENTION

Starting out from this prior art, the invention was based on the problem of providing a system of this generic category comprising at least two rigid conductors, connected together in an electrically conducting manner, which, despite the possibility of a tolerance compensation with regard to the positioning of electrical functional elements which are to be connected by means of this system, guarantees reliable transmission behavior.

This problem is solved through a system according to the claims. Advantageous embodiments of the system according to the invention are the subject matter of the claims and are explained in the following description of the invention.

The above and other objects, which will be apparent to those skilled in the art, are achieved in the present invention which is directed to a system for the transmission of electrical current comprising at least two rigid conductors wherein the two conductors are connected via at least one electrically conducting, deformable connecting element which comprises a helical spring shaped like a ring in the direction of the longitudinal axis thereof and which grips a section of a first conductor under pre-tension such that it is expanded radially, wherein it contacts at least the second conductor in a radial plane formed by the helical spring, such that the helical spring is pressed against the second conductor by a contact element.

The system includes two helical springs which each grip a section of the first conductor under pre-tension and contact the second conductor in a radial plane formed by one of the two helical springs. The contact element is preferably of electrically conducting design and is connected with the first conductor in an electrically conducting manner. The second conductor may include an opening through which the first conductor extends.

A dimension of the opening in the second conductor is greater than the corresponding external dimension of the first conductor in the section received into the opening. The opening as well as the section of the first conductor received into the opening are each circular in cross section, wherein the difference in diameter amounts to between 0.1 mm and 0.2 mm.

The first conductor may be pin-formed in design and the second conductor may be designed as a flat component.

The contact element is preferably formed as a head part of the first conductor which has a larger diameter in comparison with a pin-formed base body of the first conductor. The contact element may be in the form of a contact sleeve which is preferably connected with the first conductor in a force-locking manner. The internal diameter of a central opening in the contact sleeve is slightly less than the external diameter of a fixing section of the first conductor, wherein the contact sleeve can be pushed onto the fixing section.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
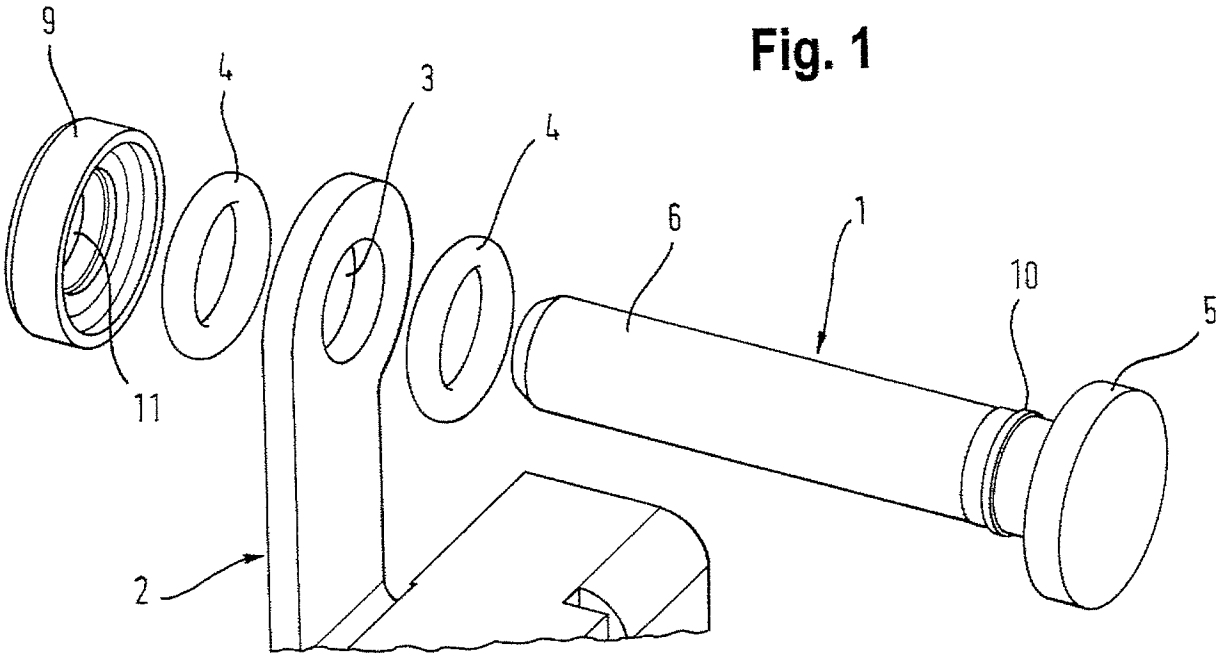
FIG. 1 shows an isometric exploded representation of a system according to the invention.

In describing the preferred embodiment of the present invention, reference will be made herein to FIGS. 1-2 of the drawings in which like numerals refer to like features of the invention.

According to the invention, a system of this generic category for the transmission of electrical current (both for the supply of energy and for the transmission of signals (including radio frequency signals) and in particular of high current (≥48 V voltage of the current source) with at least two rigid conductors connected together in an electrically conducting manner is further developed in that the two conductors are (indirectly) connected (in an electrically conducting manner) via at least one electrically conducting, deformable connecting element.

The deformable connecting element ensures a relative movability of the rigid conductors, through which tolerances in terms of the positioning of electrical functional elements which are to be connected via the system according to the invention can be compensated.

The connecting element can particularly preferably comprise a (preferably cylindrical) helical spring which is shaped like a closed ring in the direction of the longitudinal axis thereof and which grips a section of a first conductor under pre-tension. This gripping of the first conductor under pre-tension ensures a permanent contacting between the conductor and the helical spring.

A contact between the ring-formed helical spring and at least the second, preferably both conductors, preferably takes place in a radial plane formed by the ring-formed helical spring; the helical spring thus contacts the conductor(s) in a ring-formed manner and consequently over a relatively wide area. This allows a good transmission behavior for the current flowing via the system to be achieved.

Particularly preferably, (at least) two helical springs can be provided in which each grip a section of the first conductor under pre-tension and in which each contact the second conductor in a radial plane formed by the relevant helical spring. This allows the effective surface area for the transmission of the current to be relatively large.

In order to ensure that the helical springs are in permanent contact with the second conductor and thus ensure good electrical transmission behavior, it can also be the case that these are pressed against the second conductor by means of (in each case) a contact element.

Particularly preferably, the contact element(s) themselves are thereby electrically conducting in design and also connected in an electrically conducting manner with the first conductor. As a result, the first conductor contacts the ring-formed helical spring(s) not only on their inner side (with which the latter grips the first conductor), but also, in addition, via the contact element(s). As a result, the effective surface area for transmission of the current can, again, be increased.

Preferably, the second conductor, which can for example be designed in the form of a flat component, has an opening through which the first conductor extends, and which can for example be pin-formed (at least in one section). Particularly preferably, at least one dimension of the opening of the second conductor is greater than the corresponding external dimension of the first conductor in the section thereof accommodated in the opening. As a result, a relative movability of the conductors in a plurality of directions is guaranteed.

Preferably, it can also be the case that the opening as well as the section of the first conductor accommodated therein are circular in cross section, wherein the difference in diameter amounts to between 0.1 mm and 0.2 mm.

Figure 2:
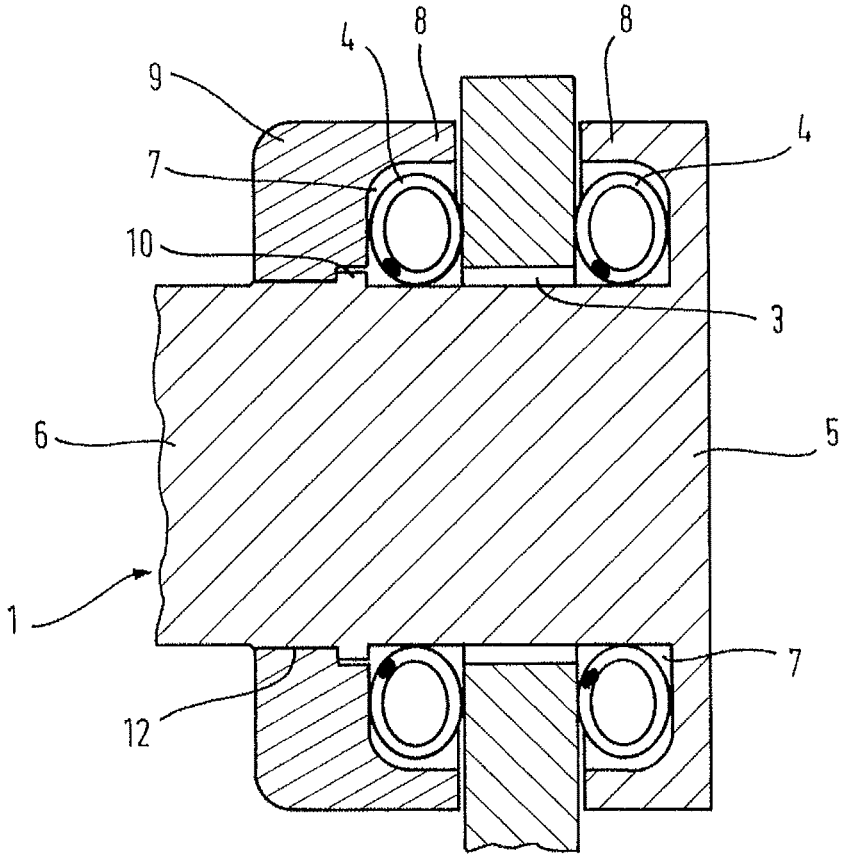
FIG. 2 shows a cross section through the system according to the invention as shown in FIG. 1.

FIGS. 1 and 2 show different views of a system according to the invention for the transmission of high current, such as can be used, for example, in the drive train of an electric motor vehicle.

The system comprises two conductors 1, 2, which are designed as relatively large-volume, solid metal components and are therefore substantially rigid. A deformation of the conductors 1, 2 during installation, for example in order to compensate positioning tolerances of electrical functional elements which are to be connected by means of the system is not therefore possible. The conductors 1, 2 are large-volume and solid in design in order to minimize their electrical resistance and consequently power loss during the transmission of high currents.

The first of two conductors 1 is pin-formed and the second conductor 2 is designed as a contact rail, i.e. as a flat component. The second conductor 2 has an opening 3 through which the first conductor 1 projects when the system is in its installed state. As can be seen from FIG. 2, the diameter of the opening 3 is greater than the external diameter of the first conductor 1 in the section in which the latter is accommodated in the opening. Through this difference in diameter, which can for example amount to between 0.1 mm and 0.2 mm, a defined movability between the two conductors 1, 2 can be achieved, not only along the longitudinal axis of the first conductor 1 but also in a radial direction thereto. This also permits a tilting (where the longitudinal axis of the first conductor is no longer aligned perpendicular to the large lateral surfaces of the second conductor) of the first conductor 1 relative to the second conductor 2.

The relative movability of the two conductors 1, 2 in relation to one another guarantees a compensation of positioning tolerances in the electrical functional elements which are to be connected by the system according to the invention.

In order to guarantee a reliable transmission of the high current via the system, irrespective of the relative position of the two conductors 1, 2, the transmission path for the high current from the first conductor 1 to the second conductor 2 is formed via two deformable connecting elements. As a result it is possible to prevent the effective surface area of the transmission path for the high current from changing depending on the relative position of the two conductors 1, 2 in relation to one another. Instead, due to the deformability of the connecting elements, the contact surface areas between the connecting elements on the one hand and the two conductors on the other substantially remain the same size, irrespective of the relative position of the conductors 1, 2 in relation to one another.

The connecting elements are designed in the form of helical springs 4 which form a closed ring in relation to the longitudinal axis defined by the coils (in relation to the coils). The internal diameters of the two ring-formed helical springs 4 (in their unloaded state) are thereby slightly smaller than the external diameter of the first conductor 1 in those sections in which it grips the first conductor 1 following installation of the system. This leads to the helical springs 4 expanding radially when these grip the corresponding sections of the first conductor 1, which as a result of the elastic reaction forces ensures that the helical springs 4 contact the first conductor 1 securely around its entire circumference.

The second conductor 2 is contacted on its two large lateral surfaces by in each case one of the helical springs 4 in a radial plane formed by the relevant helical spring 4, i.e. in a ring-formed manner.

In order to ensure a permanent contact between the two helical springs 4 and the second conductor 2, these are pressed against the second conductor 2 in each case via an electrically conducting contact element. One contact element is thereby formed as the head part 5 of the first conductor 1, which has a larger diameter in comparison with a pin-formed base body 6 of the first conductor 1. The head part 5 forms a ring-formed recess 7 in which the associate helical spring 4 is accommodated. The ring-formed recess 7 is formed by a ring-formed collar 8, the longitudinal extension of which is chosen such that the (unloaded) helical spring 4 still projects from this slightly. As a result it is ensured that when the head part 5 only presses gently against the helical spring 4 a defined distance still remains between the collar 8 and the second conductor 2, which ensures the desired movability of the first conductor 1 and the second conductor 2 in relation to one another.

The second contact element is in the form of a contact sleeve 9 which also possesses a collar 8 which forms a ring-formed recess 7 into which the associated helical spring 4 is almost completely received. This collar 8 is also so dimensioned that when the contact sleeve 9 only exerts a gentle pressure on the helical spring 4 a distance remains between the collar 8 and the second conductor 2.

The minimal distance between the two contact elements is defined constructively, for which purpose a ring-formed projection 10 is provided against which the contact sleeve 9 comes to rest. As a result it is ensured that during installation of the system the contact sleeve 9 cannot be pushed too far in the direction of the head part 5, which could otherwise lead to the distances between the contact elements and the second conductor 2 being too short.

The connection of the contact sleeve 9 with the first conductor 1 is force-locking, in that the internal diameter of the central opening 11 of the contact sleeve 9 is slightly less than the external diameter of a fixing section 12 of the first conductor 1. However, the difference in diameter is preferably so small that the contact sleeve 9 can be pushed onto the fixing section 12 manually or with the assistance of a hand tool. However, the possibility also exists of forming a press fit by heating the first conductor 1 and the contact sleeve 9 to different temperatures.

The fixing section 12 of the first conductor 1 has a slightly larger diameter than the section of the base body 6 preceding it in the plugging direction. As a result, the contact sleeve 9 can, without significant application of force, be plugged onto the base body 6 of the first conductor 1 and pushed as far as the fixing section 12.

The system according to the invention is assembled in that one of the helical springs 4 is first pushed onto the base body 6 of the first conductor 1 until this is received in the ring-formed recess 7 of the head part 5. The base body 6 of the first conductor 1 is then inserted through the opening 3 of the second conductor 2. The other helical spring 4 is then pushed onto the base body 6 of the first conductor 1 and finally the contact sleeve 9 is pushed onto the fixing section 12 of the first conductor 1.

The design of the system according to the invention enables the two conductors 1, 2 to be relatively movable (within limits) in relation to one another, both along the longitudinal axis of the first conductor 1 and also in a radial direction to this. A tilting of the first conductor 1 and second conductor 2 in relation to one another is also possible. The effective surface area for the transmission of the high current thereby substantially always remains the same, since the relative movement of the two conductors 1, 2 is absorbed by the elastically deformable helical springs 4 without the size of the contact surface areas between the two conductors 1, 2 and the two helical springs 4 changing significantly.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A system for the transmission of electrical current comprising at least a first conductor and a second conductor, wherein the first and second conductors are rigid and are connected via at least one electrically conducting, deformable connecting element which comprises a helical spring shaped like a ring in the direction of the longitudinal axis thereof and which grips a section of a first conductor under tension such that said helical spring is expanded radially, wherein a contact element is formed as a head part of the first conductor which has a larger diameter in comparison with a pin-forming base body of the first conductor, wherein said helical spring contacts at least the second conductor in a radial plane formed by said helical spring, such that the helical spring is pressed against the second conductor by said contact element, wherein the second conductor includes an opening through which the first conductor extends, and wherein the first conductor is pin-formed in design and the second conductor is designed as a flat component.

2. The system of claim 1 wherein an internal diameter of a central opening in the contact sleeve is slightly less than an external diameter of a fixing section of the first conductor, wherein the contact sleeve can be pushed onto the fixing section.

3. The system of claim 1 wherein the contact element is in the form of a contact sleeve which is preferably connected with the first conductor in a force-locking manner.

4. The system of claim 1 including a dimension of the opening in the second conductor being greater than a corresponding external dimension of the first conductor in the section received into the opening.

5. The system of claim 4 wherein the first conductor is pin-forming in design and the second conductor is designed as a flat component.

6. The system of claim 1 including another helical spring wherein both helical springs grip a section of the first conductor under tension and contact the second conductor in a radial plane formed by one of said helical springs.

7. The system of claim 6 wherein the second conductor includes an opening through which the first conductor extends.

8. The system of claim 6 wherein the contact element is of electrically conducting design and is connected with the first conductor in an electrically conducting manner.

9. The system of claim 8 wherein the second conductor includes an opening through which the first conductor extends.

10. The system of claim 9 including a dimension of the opening in the second conductor being greater than a corresponding external dimension of the first conductor in the section received into the opening.

11. The system of claim 10 wherein the opening as well as the section of the first conductor received into the opening are each circular in cross section, wherein the difference in diameter amounts to between 0.1 mm and 0.2 mm.

12. The system of claim 4 wherein the opening as well as the section of the first conductor received into the opening are each circular in cross section, wherein the difference in diameter amounts to between 0.1 mm and 0.2 mm.

13. The system of claim 12 wherein the first conductor is pin-formed in design and the second conductor is designed as a flat component.

14. The system of claim 1 wherein the contact element is of electrically conducting design and is connected with the first conductor in an electrically conducting manner.

15. The system of claim 14 wherein the contact element is in the form of a contact sleeve which is preferably connected with the first conductor in a force-locking manner.

16. The system of claim 15 wherein an internal diameter of a central opening in the contact sleeve is slightly less than an external diameter of a fixing section of the first conductor, wherein the contact sleeve can be pushed onto the fixing section.

17. The system of claim 4 wherein the contact element is in the form of a contact sleeve which is preferably connected with the first conductor in a force-locking manner.

18. The system of claim 17 wherein an internal diameter of a central opening in the contact sleeve is slightly less than an external diameter of a fixing section of the first conductor, wherein the contact sleeve can be pushed onto the fixing section.

* * * * *